US008978303B1

(12) United States Patent
Rogers et al.

(10) Patent No.: US 8,978,303 B1
(45) Date of Patent: Mar. 17, 2015

(54) WINDOW SASH TILT LATCH AND METHOD

(71) Applicants: Christopher R. Rogers, Winston Salem, NC (US); Farrell D. Smith, Sophia, NC (US)

(72) Inventors: Christopher R. Rogers, Winston Salem, NC (US); Farrell D. Smith, Sophia, NC (US)

(73) Assignee: Hughes Supply and Mfg. Co. of Thomasville, Inc., Thomasville, NC (US)

( * ) Notice: Subject to any disclaimer, the term of this patent is extended or adjusted under 35 U.S.C. 154(b) by 0 days.

(21) Appl. No.: 13/654,785

(22) Filed: Oct. 18, 2012

(51) Int. Cl.
*E05D 15/22* (2006.01)

(52) U.S. Cl.
USPC ..... 49/185; 292/175

(58) Field of Classification Search
CPC ..... E05B 9/08; E05B 65/087; E05B 9/00; E05C 1/10
USPC ..... 49/183–185; 292/175, 337, DIG. 47
See application file for complete search history.

(56) References Cited

U.S. PATENT DOCUMENTS

| | | | | | |
|---|---|---|---|---|---|
| 4,790,582 | A | | 12/1988 | Keast | 292/288 |
| 4,961,286 | A | * | 10/1990 | Bezubic | 49/175 |
| 5,139,291 | A | | 8/1992 | Schultz | 292/42 |
| 5,219,195 | A | | 6/1993 | Lawrence | 292/336.3 |
| 5,248,174 | A | | 9/1993 | Matz et al. | 292/338 |
| 5,536,052 | A | | 7/1996 | Maier | 292/63 |
| 5,669,180 | A | | 9/1997 | Maier | 49/181 |
| 5,669,639 | A | | 9/1997 | Lawrence | 292/175 |
| 5,970,656 | A | | 10/1999 | Maier | 49/181 |
| 5,996,283 | A | | 12/1999 | Maier | 19/181 |
| 6,068,306 | A | | 5/2000 | Brautigam | 292/242 |
| 6,142,541 | A | | 11/2000 | Rotondi | 292/241 |
| 6,364,375 | B1 | | 4/2002 | Szapucki et al. | 292/63 |
| 6,450,554 | B1 | | 9/2002 | Rotondi et al. | 292/158 |
| 6,484,444 | B1 | | 11/2002 | Polowinczak | 49/449 |
| RE37,916 | E | * | 12/2002 | Szapucki et al. | 292/175 |
| 6,568,723 | B2 | | 5/2003 | Murphy et al. | 292/241 |
| 6,767,038 | B1 | | 7/2004 | Huml | 292/158 |
| 6,832,792 | B2 | * | 12/2004 | Polowinczak et al. | 292/36 |
| 6,854,214 | B2 | | 2/2005 | Polowinczak | 49/449 |
| 6,871,886 | B2 | | 3/2005 | Coleman et al. | 292/241 |
| 6,874,826 | B1 | * | 4/2005 | Polowinczak et al. | 292/175 |
| 7,000,957 | B2 | | 2/2006 | Lawrence | 292/241 |
| 7,063,361 | B1 | | 6/2006 | Lawrence | 292/241 |
| 7,096,626 | B2 | * | 8/2006 | Heng et al. | 49/185 |
| 7,171,784 | B2 | * | 2/2007 | Eenigenburg | 49/181 |
| 7,222,458 | B2 | * | 5/2007 | Polowinczak et al. | 49/181 |
| 7,237,811 | B1 | | 7/2007 | Lawrence | 292/39 |
| 7,322,620 | B1 | | 1/2008 | Lawrence | 292/242 |
| 7,441,811 | B2 | | 10/2008 | Lawrence | 292/110 |
| 7,520,541 | B1 | | 4/2009 | Lawrence | 292/175 |
| 7,588,271 | B1 | | 9/2009 | Lawrence | 292/241 |
| 7,658,035 | B1 | * | 2/2010 | Lawrence | 49/185 |
| 7,922,223 | B2 | | 4/2011 | Lawrence | 292/241 |
| 8,186,102 | B1 | | 5/2012 | Lawrence | 49/185 |
| 2003/0047948 | A1 | * | 3/2003 | Polowinczak et al. | 292/36 |
| 2004/0074146 | A1 | * | 4/2004 | Eenigenburg | 49/183 |
| 2004/0262929 | A1 | | 12/2004 | Trickel | 292/241 |
| 2006/0028028 | A1 | * | 2/2006 | Schultz | 292/175 |
| 2007/0056217 | A1 | * | 3/2007 | Silverman | 49/185 |
| 2007/0284891 | A1 | * | 12/2007 | Polowinczak et al. | 292/175 |
| 2009/0223130 | A2 | * | 9/2009 | Ozawa | 49/185 |

* cited by examiner

*Primary Examiner* — Katherine Mitchell
*Assistant Examiner* — Scott Denion
(74) *Attorney, Agent, or Firm* — Blake P. Hurt

(57) ABSTRACT

An easy to assemble tilt latch includes a spring loaded bolt. The latch housing includes a plurality of clips to engage the sash to hold it in place in a precut opening. A driver fixed to a top slide passes through an opening in the housing and engages the bolt for retracting the bolt.

10 Claims, 4 Drawing Sheets

WINDOW SASH TILT LATCH AND METHOD

FIELD OF THE INVENTION

The invention herein pertains to window latches and particularly pertains to an easy to assemble tilt latch as used with double hung or other conventional windows.

DESCRIPTION OF THE PRIOR ART AND OBJECTIVES OF THE INVENTION

In recent years double hung windows/sashes with tilting lower sashes have become increasingly used due to consumer demands. Such windows are generally formed from polyvinyl chloride (PVC) due to their lightweight, low cost and ease in use and assembly. Various types of tilt latches have become available over the years and manufacturers provide tilt latches which can be assembled and pre-installed in window sashes. Many standard tilt latches require careful machining and routing of the sashes before installation can be completed. Other conventional tilt latches are complex in structure and are difficult to assemble, install and replace.

Thus, in view of the problems and disadvantages associated with conventional tilt latches, the present invention was conceived and one of its objectives is to provide a tilt latch which can be easily installed or replaced as needed.

It is another objective of the present invention to provide a tilt latch which can be used by a consumer without difficulty.

It is still another objective of the present invention to provide a tilt latch which is relatively inexpensive to manufacture and sell, yet is durable in use.

It is yet another objective of the present invention to provide a tilt latch having only a small number of parts for ease in assembly and installation.

It is a further objective of the present invention to provide a tilt latch having a resilient member for biasing the bolt.

It is still a further objective of the present invention to provide a tilt latch having a U-shape housing.

Various other objectives and advantages of the present invention will become apparent to those skilled in the art as a more detailed description is set forth below.

SUMMARY OF THE INVENTION

The aforesaid and other objectives are realized by providing a window sash tilt latch having a slide, housing and bolt which are assembled and installed within a precut opening of a window sash rail. The bolt includes a cradle for containing a resilient member such as a coil spring which is urged against the inside rear of the U-shaped wall of the housing. The slide includes a depending driver which passes through an opening in the housing and tightly engages an aperture in a bolt therebelow. Once installed in the sash the user, by moving the finger tab rearwardly from the edge of the sash will cause the slide and bolt to retract allowing the window to be opened or disengaged from the window frame for tilting purposes. Clips along the housing engage the sash to hold the assembled tilt latch in place. A coil spring is utilized to provide and urge the bolt in a normal extended posture.

In the method of operation, the tilt latch is assembled and positioned in a precut opening along the top of a conventional bottom window sash. Thereafter, in use a finger tab on the slide drives the slide and driver rearwardly or away from the window frame causing the bolt to retract and allow the window sash to then tilt or rotate from the window frame.

BRIEF DESCRIPTION OF THE DRAWINGS

FIG. 1 shows a fragmented partial view of a precut window sash having an opening for the bolt along the side edge thereof and an opening in the top of the sash rail to allow the latch housing to pass through;

DETAILED DESCRIPTION OF THE PREFERRED EMBODIMENT AND OPERATION OF THE INVENTION

Figure 1:
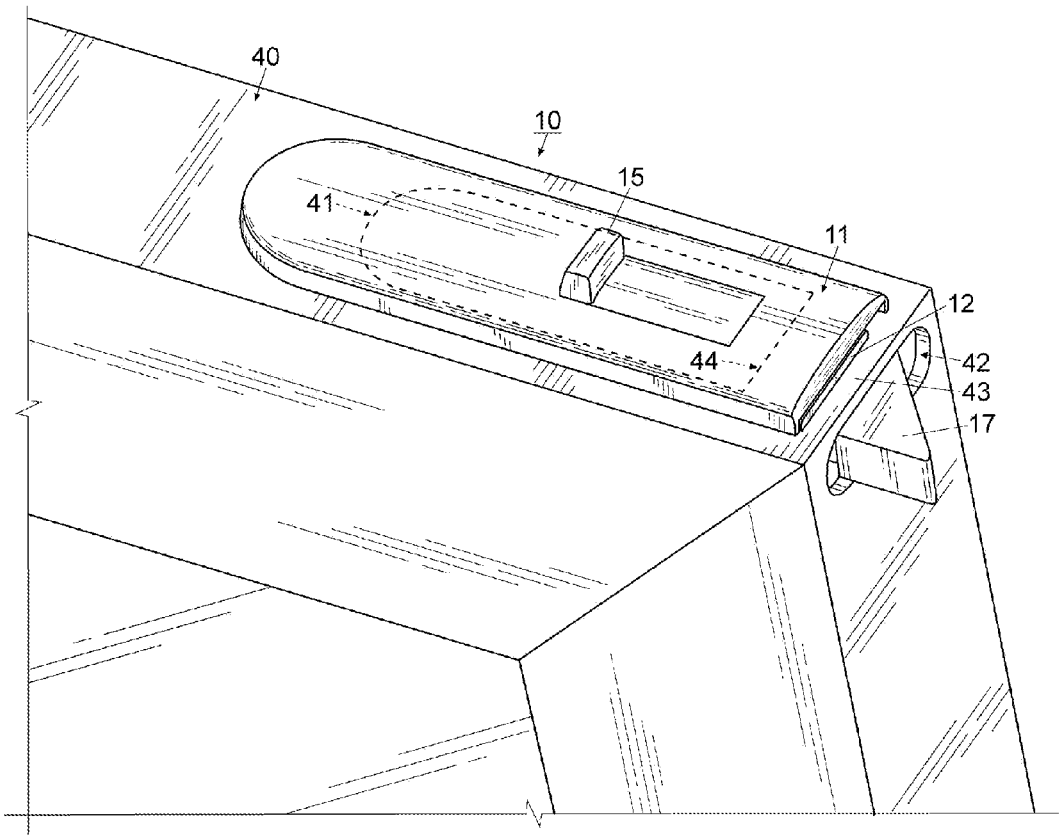
Figure 2:
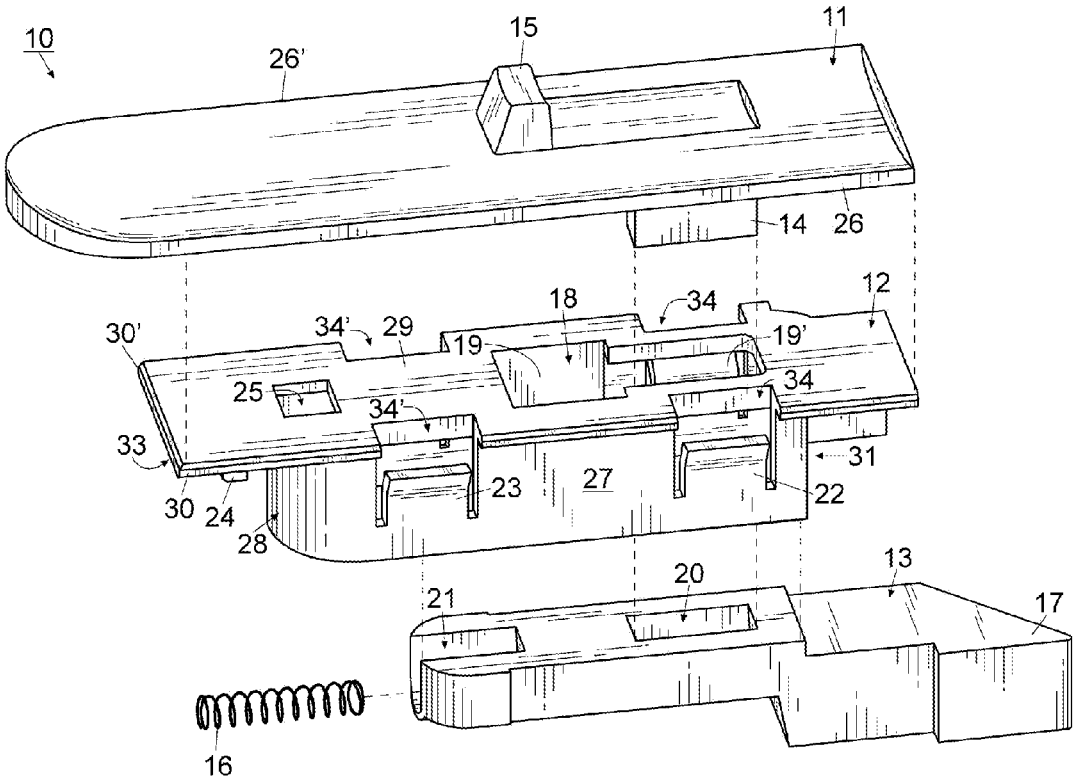
FIG. 2 demonstrates an exploded view of the tilt latch of the invention.
Figure 4:
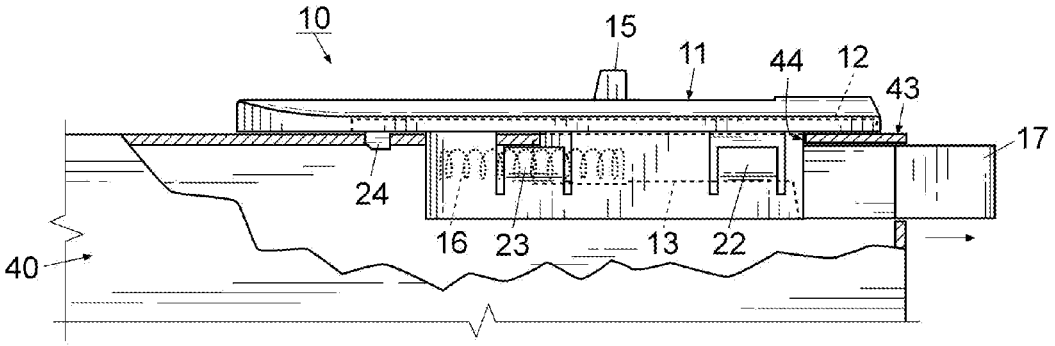
FIG. 4 depicts a side elevational view of the fragmented sash with the tilt latch installed in the sash rail and the bolt in an extended position.
Figure 5:
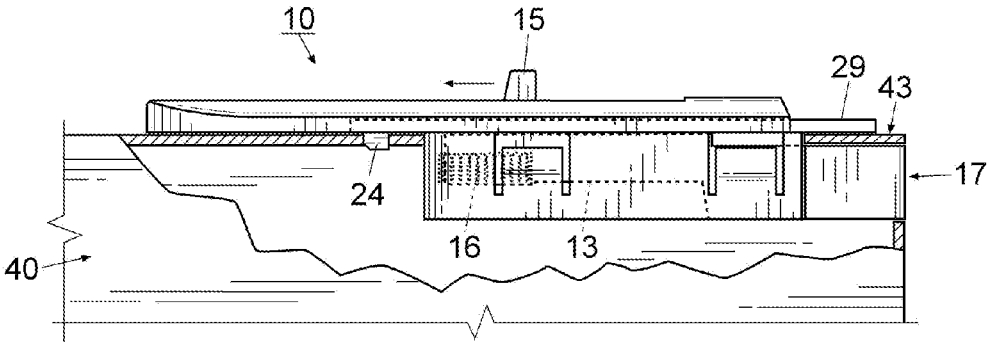
FIG. 5 illustrates a side elevational view of the installed tilt latch as in FIG. 4 but with the bolt retracted.
Figure 6:
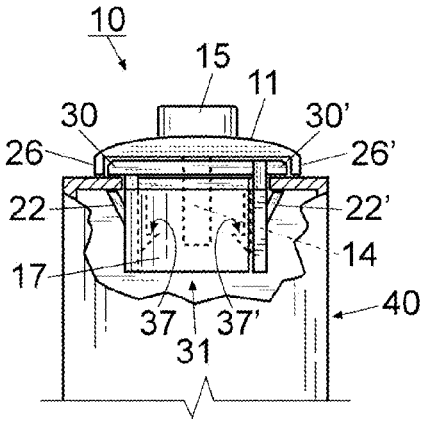
FIG. 6 features a front elevational view of the edge of the window sash in cut-away fashion with the tilt latch installed.

For a better understanding of the invention and its operation, turning now to the drawings, FIG. 1 illustrates a fragmented perspective view of a corner of typical bottom window sash 40 as used in a double hung window with preferred tilt latch 10 inserted therein. Prior to assembly, window sash 40 has been cut or grooved to including opening 41 to allow installation of tilt latch 10 as also illustrated in FIGS. 4, 5 and 6. Opening 41 as shown in dotted line fashion in FIG. 1 includes end edge 44 as also seen in FIG. 4 proximate front member 43 of sash 40. In FIG. 2 tilt latch 10 is shown in exploded fashion demonstrating slide 11, housing 12 and bolt 13. Resilient member 16 of bolt 13 fits within cradle 21 and is urged against the inside of rear 28 of U-shaped wall 27 of housing 12. Preferably resilient member 16 comprises a coil spring.

Slide 11 as seen in FIG. 2 includes finger tab 15 on top thereof and driver 14 opposingly positioned on the bottom and integrally formed therewith. Slide 11 is U-shaped and also includes inset 36 (FIG. 3) and opposing vertical edges 26, 26' (FIG. 6). Inset 36 is formed therein to receive top 29 of housing 12 as described in more detail below.

Figure 7:
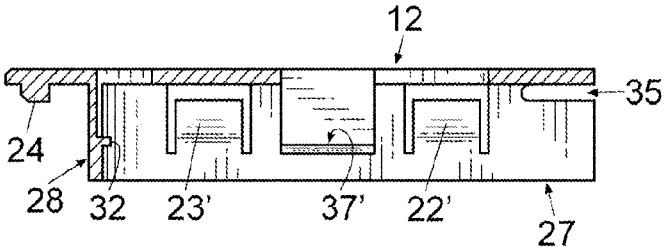
FIG. 7 pictures a side elevational view of the latch housing as cut along lines 7-7 as seen in FIG. 3 with the slide and bolt removed for clarity.

Housing 12 includes planar top 29 having intermittent side edges 30, 30' that each define notches 34, 34' (FIG. 2) and includes top opening 18 and rectangular aperture 25 formed therein. Top 29 is integrally formed with U-shaped wall 27 therebelow which is sized to receive and slideably contain bolt 13 therein. Top 29 extends beyond U-shaped wall 27 forming ledge 33 and further includes mounting tab 24 on the bottom of ledge 33 to assist in positioning and maintaining housing 12 within window sash 40 (FIGS. 4 and 5). U-shaped wall 27 includes front opening 31 in opposing position to arcuate shaped rear 28 and further includes respectively opposingly positioned front and rear clips 22, 22', 23, 23' (22', 23' see FIG. 7) along the sides thereof for snap fitting within window sash opening 41 (FIGS. 1 and 6). Housing top opening 18 includes a larger, major portion 19 and a smaller, minor portion 19' for slideably receiving driver 14 therein. As shown in FIG. 6 clips 22, 22', 23, 23' have an arcuate shape extending outwardly from housing 12 for engaging the edges of sash opening 41 (FIG. 1) to prevent removal. Clips 22, 22', 23, 23' are positioned on U-shaped wall 27 proximate the discontinuous portions of edges 30, 30' as seen in FIG. 2. As seen in FIGS. 2 and 7 one side of U-shaped wall 27 extends outwardly proximate the end of housing 12 and includes gap 35 formed therein below top 29 which engages end edge 44 of sash top opening 41 (FIG. 1) to stabilize housing 12 in place. Shelves 37, 37' (FIG. 7) are formed along each side of U-shaped wall 27 between respectively clips 22, 23 and clips 22', 23' for maintaining and guiding bolt 13 in a horizontal posture within housing 12 during assembly and operation. Spring ledge 32 is formed along the inside of rear 28 of U-shaped wall 27 to support resilient member 16.

Figure 3:
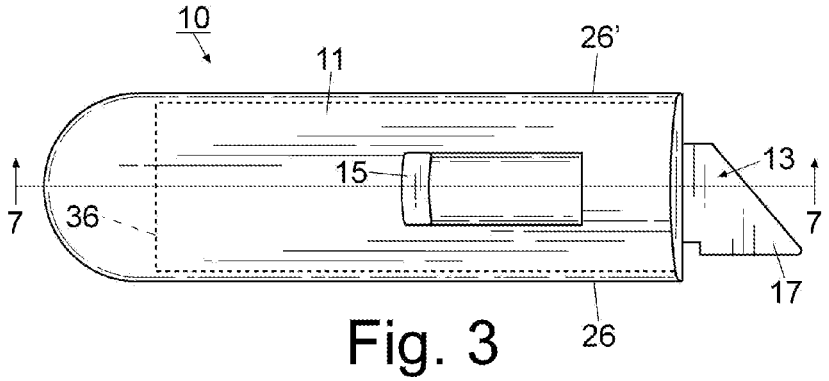
FIG. 3 pictures a top plan view of the tilt latch removed from the window sash rail with the bolt extended.

Bolt 13 includes nose 17, bolt aperture 20 and cradle 21. Nose 17 has a triangular shape as seen in FIG. 3 and is taller in height than the opposing end of bolt 12 as seen in FIGS. 2, 4 and 5 which is narrower and rides along shelves 37, 37' (37' shown in FIG. 7). Bolt aperture 20 is sized to receive driver 14 of slide and cradle 21 maintains resilient member 16. Bolt 13 is slideably received through front opening 31 generally seen in FIG. 6 of housing 12 whereby resilient member 16 is held in place within cradle 21 and abuts the inside of rear 28 of wall 27 where it rests on spring ledge 32 which assists in maintaining alignment of resilient member 16. Housing 12 is then slideably received within slide 11 as edges 30, 30' of housing 12 slide within inset 36. Driver 14 is received within bolt aperture 20 during assembly.

When assembled, driver 14 of slide 11 fits within housing top opening 18 and is slideably movable between major portion 19 and minor portion 19' of opening 18 during use. Driver 14 further fits within bolt aperture 20 such that when finger pressure is applied to finger tab 15 of slide 11, bolt 13 and slide 11 move in unison for slideably retracting nose 17. Front clips 22, 22' (FIG. 6) and rear clips 23, 23' engage window sash 40 as seen in FIGS. 4 and 6. During use, nose 17 of bolt 13 engages a stile opening (not shown) in the window frame (not shown). In order to allow sash 40 to tilt, finger tab 15 is urged in a right to left direction as seen in FIGS. 1, 4 and 5 thereby retracting nose 17 from the stile opening (not shown) to allow sash 40 to rotate or tilt outwardly from the window frame (not shown). Finger tab 15 causes driver 14 engaged within bolt aperture 20 to move from minor opening 19' to major opening 19 in housing top opening 18 while simultaneously moving bolt 13 rearwardly to compress resilient member 16 within cradle 21 thus retracting nose 17 as seen in FIG. 5 from the window frame (not shown). A portion of bolt 13 is shown in dashed line format in FIGS. 4 and 5 to show the retraction and movement of bolt 13 from a fully extended posture (FIG. 4) to a retracted posture (FIG. 5).

In addition to driver 14 engaging bolt 13, vertical edges 26, 26' of slide 11 engage and move along side edges 30, 30' of top 29 of housing 12. Mounting tab 24 acts as a stop to prevent housing 12 from moving within window sash 40 while slide 11 and bolt 13 move as seen in FIG. 5. Tilt latch 10 is formed from a conventional durable polymeric material although other materials such as metal may be used but are not preferred.

In the preferred method of use, tilt latch 10 is assembled as described above. After assembly, tilt latch 10 is then urged through the precut top opening 41 (seen in dashed lines in FIG. 1) in sash 40 which may be for example a conventional vinyl window sash. Nose 17 of bolt 13 is received within opening 42 and tilt latch 10 is snapped into engagement with sash 40 whereby clips 22, 22', 23, 23' engage the side edges thereof as seen in FIG. 6 and gap 35 engages end edge 44 of front member 43 as seen in FIG. 4 of sash rail opening 41. Upon closing sash 40 from a tilted posture, nose 17 of bolt 13 contacts the window frame (not shown) and is urged into housing 12 while compressing resilient member 16. Once sash 40 is fully closed, nose 17 extends within the opening (not shown) of the window frame (not shown) as resilient member 16 decompresses and fully extends nose 17 outwardly to maintain sash 40 in a closed vertical or non-tilted position. If it is later desirable to tilt sash 40 outwardly, finger tab 15 is directed from the window frame (not shown) by manual finger pressure to retract bolt 13 and nose 17 and allow sash 40 to then be tilted outwardly away from the window frame. While only one side of sash 40 is described herein for simplicity, as would be understood, most sashes include tilt latches on each side on the window sash.

The illustrations and examples provided herein are for explanatory purposes and are not intended to limit the scope of the appended claims.

We claim:

1. A tilt latch comprising: a housing, said housing comprises at least one pair of opposing notches, each notch creating a through opening from an outer edge of said housing toward a longitudinal centerline of said housing, and a U-shaped wall, a spring ledge, said spring ledge positioned on an inside of said U-shaped wall, at least one outwardly extending arcuate clip, said at least one clip attached to said U-shaped wall beneath a respective one of said notches, a bolt, said bolt contained within said housing, said housing defining a top opening, said housing top opening comprises a minor section positioned between said at least one pair of notches and a major section, said minor section in communication with said major section, said bolt defining an aperture, a slide, a bolt driver, said bolt driver depending from said slide, said bolt driver positioned within said housing top opening and said bolt aperture, a resilient member, said resilient member positioned between said bolt and said housing and resting on said spring ledge, whereby moving said slide causes said bolt driver to move between said minor section and said major section, and whereby said clip prevents displacement of said housing.

2. The tilt latch of claim 1 wherein said housing top opening is larger than said bolt aperture.

3. The tilt latch of claim 1 wherein said slide comprises a finger tab, said finger tab positioned in opposing relation to said bolt driver.

4. The tilt latch of claim 1 wherein said housing comprises a top, said top positioned on said U-shaped wall and extending therebeyond defining a top ledge, said U-shaped wall defining a gap, said gap for engaging an end edge of a sash opening.

5. The tilt latch of claim 4 further comprising a mounting tab, said mounting tab positioned on said top ledge, and said mounting tab extending downwardly from said top ledge.

6. The tilt latch of claim 1 wherein said bolt defines a resilient member cradle, said resilient member mounted in said resilient member cradle.

7. The tilt latch of claim 6 wherein said bolt defines a biased nose.

8. The tilt latch of claim 4 wherein at least one said outwardly extending arcuate clip is one of a pair of outwardly extending arcuate clips, said pair of clips each positioned beneath one of said notches and attached to said U-shaped wall beneath said top ledge.

9. The tilt latch of claim 4 further comprising a pair of shelves, said pair of shelves affixed to said U-shaped wall beneath said top ledge, said pair of shelves for guiding said bolt.

10. A tilt latch in combination with a sash, said sash defining a top opening and a side opening, said tilt latch comprising a housing, said housing comprises a U-shaped wall and a top defining two pairs of opposing notches, said top positioned on said U-shaped wall and extending therebeyond defining a top ledge, a plurality of outwardly extending arcuate clips, said plurality of clips each positioned beneath one of said notches and attached to said U-shaped wall beneath said top ledge, a mounting tab, said mounting tab positioned on said top ledge and extending downwardly therefrom, said U-shaped wall defining a gap, said gap configured to receive said sash therein, a spring ledge, said spring ledge positioned on an inside of said U-shaped wall, a bolt defining a biased nose, said bolt contained within said housing, a pair of shelves, said pair of shelves affixed to said U-shaped wall beneath said top ledge, said pair of shelves for guiding said bolt, said housing defining a top opening, said housing top opening comprises a minor section positioned between one of said pairs of opposing notches and a major section, said minor section in communication with said major section, said bolt defining an aperture, said housing top opening larger than said bolt aperture, a slide, a bolt driver, said bolt driver depending from said slide, said bolt driver positioned within said housing top opening and said bolt aperture, said slide comprising a finger tab, said finger tab positioned in opposing relation to said bolt driver, a resilient member, said resilient member positioned between said bolt and said housing and resting on said spring ledge, said bolt defining a resilient member cradle, said resilient member mounted in said resilient member cradle; whereby each of said clips engage said sash to prevent displacement of said housing from said sash, and whereby said sash is received within said gap, and whereby moving said slide causes said bolt driver to move between said minor section and said major section, and whereby moving said slide retracts said bolt nose within said sash.

* * * * *